United States Patent [19]

Smith

[11] Patent Number: 4,892,219

[45] Date of Patent: Jan. 9, 1990

[54] PLUGGING DEVICE

[76] Inventor: Russell W. Smith, 39 Proctor St., Manchester, Mass. 01944

[21] Appl. No.: 303,018

[22] Filed: Jan. 30, 1989

Related U.S. Application Data

[63] Continuation of Ser. No. 582,048, Feb. 21, 1984, abandoned.

[51] Int. Cl.[4] ..... B65D 51/00

[52] U.S. Cl. ..... 220/287; 138/98; 114/227; 425/13; 29/402.09; 152/370; 156/97

[58] Field of Search ..... 138/89, 92, 94, 97, 138/98; 114/227, 229; 29/402.09; 425/11, 13, 14; 152/370; 383/66, 96, 902, 907; 220/233, 234, 238, 239, 287; 156/97

[56] References Cited

U.S. PATENT DOCUMENTS

| | | | |
|---|---|---|---|
| 503,079 | 8/1893 | Gowen | 114/227 |
| 583,436 | 5/1897 | Hatch | 152/370 |
| 1,301,204 | 4/1919 | Warner et al. | 114/227 |
| 2,127,871 | 8/1938 | Kozloff | 114/227 |
| 2,220,085 | 3/1939 | Dirschel | 114/227 |
| 2,321,515 | 6/1943 | Rice | 114/227 |
| 2,476,601 | 7/1949 | Harper | 114/227 |
| 3,035,626 | 5/1962 | Mullen | 152/370 |
| 4,313,774 | 2/1982 | Arthur | 15/229 R |
| 4,329,132 | 5/1982 | Melvold et al. | 425/13 |

*Primary Examiner*—Jimmy G. Foster
*Assistant Examiner*—Nova Stucker

[57] ABSTRACT

A plugging device and system for plugging apertures in panels, and which is particularly useful in plugging irregular apertures in, for example, hulls of water-going vessels. The plugging device includes a body member from which depend a plurality of fingers generally configured in a bundle. When in use, the body member is pushed through the aperture, and the periphery of the aperture forces the fingers to a configuration so as to effectively seal the aperture. The system includes several types of push rods and mechanisms for retaining the plugging device in the aperture.

11 Claims, 3 Drawing Sheets

PLUGGING DEVICE

This is a continuation application of U.S. patent application Ser. No. 582,048 filed Feb 21, 1984 now abandoned.

BACKGROUND OF THE INVENTION

1. Field of the Invention

The invention relates generally to the field of devices for plugging apertures in panels or the like, and is particularly useful in plugging apertures in tanks or pipes or in the hulls of boats or other water-going vessels. The invention is particularly advantageous in plugging irregularly-shaped apertures which can not be plugged by conventional cylindrical or conically-shaped stoppers.

2. Description of the Prior Art

A number of devices have been designed to plug apertures, the best known of which is a conical stopper make of rubber or cork. Conventional stoppers of this shape are, however, not very useful if the aperture is a puncture made, for example, by a pin or a nail, or if it is irregular, as the conical stopper is not able to seal around the irregularities of the aperture.

In addition to a conical stopper, several other types of devices have been designed to plug apertures. One such device, disclosed in U.S. Pat. No. 3,540,420 issued to R. F. Shores on Apr. 7, 1970, comprises a device having a nipple that is elongated by a special tool, which elongation causes a reduction in the diameter of the nipple. When in the elongated condition, the nipple is inserted into the aperture. The nipple is then allowed to relax, which allows the diameter of the nipple to enlarge and seal the aperture. The utility of this device, however, is generally limited to a narrow range of aperture sizes, specifically the range between the diameter when the nipple is elongated and the diameter when it is relaxed. Furthermore, the device requires the use of the special tool to insert the device. Another device, disclosed in U.S. Pat. No. 4,329,132, issued to R. W. Melvoid et al on May 11, 1982, can be used in a wider range of aperture sizes, but requires substantially more complex insertion hardware. This device comprises a flexible, inelastic bag which is inserted into the aperture in a collapsed condition. A foamable material generated by the insertion hardware is injected into the bag to cause it to expand and seal the aperture. Neither device, however, is useful in sealing punctures, which require string-like devices such as disclosed in U.S. Pat. No. 3,282,320, issued to E. F. Klouza on Nov. 1, 1966, and U.S. Pat. No. 3,035,626, issued to T. W. Mullen on May 22, 1962.

It is evident, however, that all of these plugging devices are limited to sealing a relatively narrow range of sizes of apertures and at least some of them require special tooling or hardware to insert them and make them stay in the apertures after insertion. Furthermore, none of these are particularly useful in sealing very irregularly shaped apertures.

SUMMARY OF THE INVENTION

The invention provides a new and improved aperture-plugging device that is useful in sealing apertures which may be formed, for example, in tanks, in the sidewalls or ends of tubing or pipes, or in the hulls of boats or other water-going vessels, and which is particularly useful in sealing irregular apertures. The device comprises a central body member of preferably a resilient material from which extends a plurality of flexible, narrow fingers. The fingers may be bundled together to form a cone-like structure with the central body member at the front, relatively narrow end of the structure. When in use, the central body member is forced first through the aperture, and the fingers become lodged against the periphery defining the aperture. The bundled fingers may be shifted relative to each other to allow the cross-section of the bundle to conform to the shape of the aperture, which allows irregular apertures to be efficiently sealed. In addition, if a puncture-like or very narrow aperture is to be sealed, one or several fingers may be pushed through the aperture to seal it. Depending on its size, the device may be inserted by hand, and, in such a case, no special hardware would be needed to insert the device. Further, several of the devices can be used together to seal one aperture if the aperture is too large for one such device, the devices can be used to seal apertures of a substantial range of sizes.

Although no insertion device may be required, insertion devices having numerous forms can be used with the plugging device. For example, a simple push-rod can be used to push the central body member through the aperture. The head of the push rod can be enlarged so that it, in combination with the plugging device, may resist forces which may attempt to push the device back out of the aperture. Similarly, if the device is used in sealing apertures in ships, it and/or the push rod can be partially or entirely made of a hydrophilic material, which will expand on exposure to water to more thoroughly seal the aperture. In addition, a mechanism can be clipped to the periphery of the aperture before the device is inserted which will allow leverage to be applied to the push-rod, and which may be used to prevent the device from being pushed back out of the aperture by pressure, for example, inside the tank or pipe or outside the boat hull.

BRIEF DESCRIPTION OF THE DRAWINGS

The invention is pointed out with particularity in the appended claims. The above and further advantages of the invention may be better understood by referring to the following description taken in conjunction with the accompanying drawings, in which:

DETAILED DESCRIPTION OF THE PREFERRED EMBODIMENTS

Figure 1:
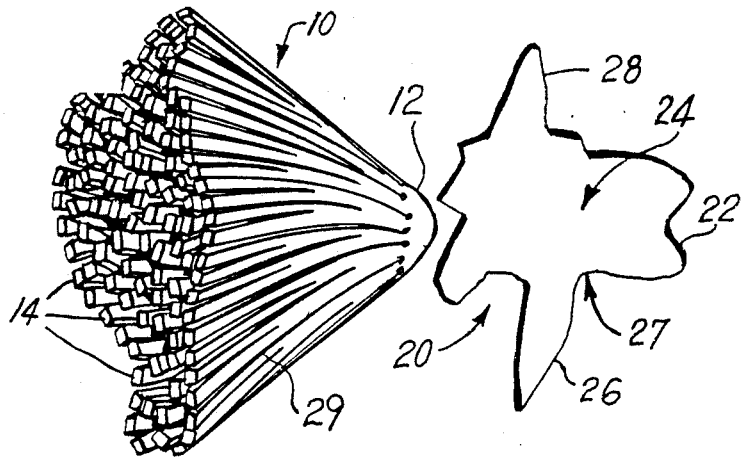
FIG. 1 is a side elevational view of a plugging device constructed in accordance with the invention.

With reference to FIG. 1, a plugging device 10 constructed in accordance with the invention includes a forward body member 12 to which a plurality of fingers 14 are attached extending in a bundle towards the rear, or to the left as shown in FIG. 1. The body member and fingers may be formed of the same material, of for example, a flexible and resilient material such as a natural or synthetic rubber such as neoprene, and in such a case they may be formed as a single unit.

Also shown in FIG. 1 is an irregular aperture 20 formed in a panel defined by a periphery 22. It will be appreciated that a conventional conical stopper, for example, would not be capable of sealing the aperture 20, but it can be efficiently sealed by plugging device 10. In particular, the body member 12 of the plugging device can be inserted through the large central region 24 of the aperture. The trailing fingers 14 will be forced by the periphery 22 of the aperture to shift into a configuration so as to seal the irregularities in the aperture, such as represented by irregularities 26 and 28. The plugging device is primarily held in aperture 20 by the frictional force at the points of contact between the periphery 22 and the plugging device 10. However, it will be appreciated that, if forces acting from the right, as shown in FIG. 1, begin to push the plugging device to the left out of the aperture, a pointed member 27 in the periphery may catch onto the plugging device, specifically at a point 29 where two fingers come together.

With further reference to FIG. 1, it can be seen that the periphery of the aperture in the region of the irregularities forces the fingers 14 to move out of their generally conical bundled orientation in their rest condition prior to being pushed into the aperture, and will force them to pack into the irregularities, thereby effectively sealing the aperture. While it is apparent that there are interstices between fingers 14 which may allow some communication between sides of the panel in which the aperture is formed, such communication will be minimized if the fingers are resilient, thereby allowing them to compress somewhat against each other when in the aperture and seal off the interstices which might otherwise result.

As has been noted above, the plugging device 10 can be formed in one piece. Specifically, the device can be formed from a conventional conical stopper of rubber or the like. The fingers 14 can be simply formed by cleaving the stopper from the large end toward the smaller end in a series of parallel cuts first in one direction, then in a direction orthogonal to the first direction, which will result in fingers generally having a rectangular cross-section. Fingers of different cross-sections may be formed by varying the relative orientations of the cuts which form them. The body member 12 comprises the top or small-diameter end of the stopper from which the device 10 is formed. The number and length of fingers 14 will depend on the size of the stopper from which the plugging device is formed as it is generally desirable to provide that the fingers have at least a predetermined minimum cross-section at the point at which they connect to the body member 12, the minimum being determined by the the amount of contact at that point which is needed to ensure that the finger will not break off from the body member at that point.

Figure 2:
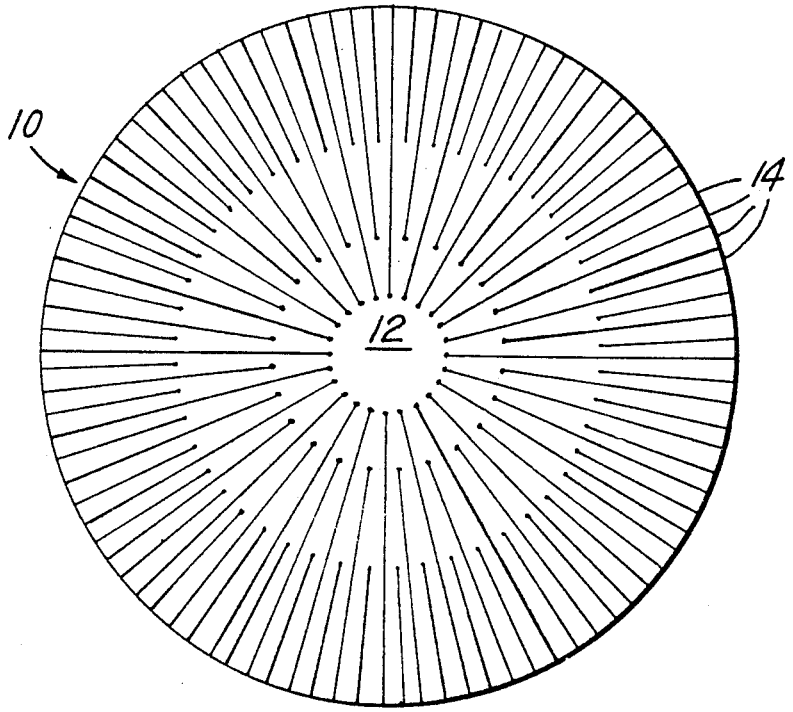
FIG. 2 is a top view illustrating the construction of one embodiment of the invention.

FIG. 2 illustrates another configuration of the plugging device. In particular, FIG. 2 is a top elevational view of a disk, also preferably of a flexible and resilient material such as rubber, neoprene, or like material, the fingers 14 being formed by radial cleavages along the lines shown in the figure. The cleavages may be formed by cutting a previously formed disk, or they may be molded in at the time the disk is formed. The cleavages which form the fingers 14 do not extend inwardly of a selected minimum radius which defines body member 12. In use, the fingers may be gathered together on one side of the body member portion of the disk as shown in FIG. 1 with body member 12 at a front or leading end and the fingers drawn back into a bundle towards the rear.

As shown in FIG. 2, beginning at selected radii from the center, the fingers are further subdivided so as to maintain the width of the fingers between selected minimums and maximums. The disk depicted in FIG. 2 has cleavages which terminate at three different radii. Depending on the size of the disk that is used and the range of the widths of the fingers, fewer or more cleavages may be required which terminate at differing radii from body member 12. Terminating the cleavages at different radii provides several advantages, including allowing the fingers to have at least a minimum area of attachment to other fingers or to the body member 12, and also allows the fingers to maintain a relatively uniform width, the fingers being subdivided from the point at which they reach the desired maximum width. In addition, subdividing the fingers provides a greater number of fingers towards the rear of the plugging device, which may allow for more effective packing of the fingers in the aperture and more efficient sealing of the irregularities.

Figure 3A:
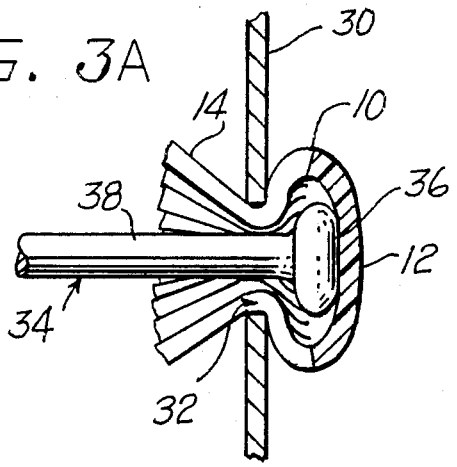
FIGS. 3A, 3B and 3C illustrate various insertion and retaining devices which may be used in conjunction with the plugging device depicted in FIGS. 1 and 2.
Figure 3B:
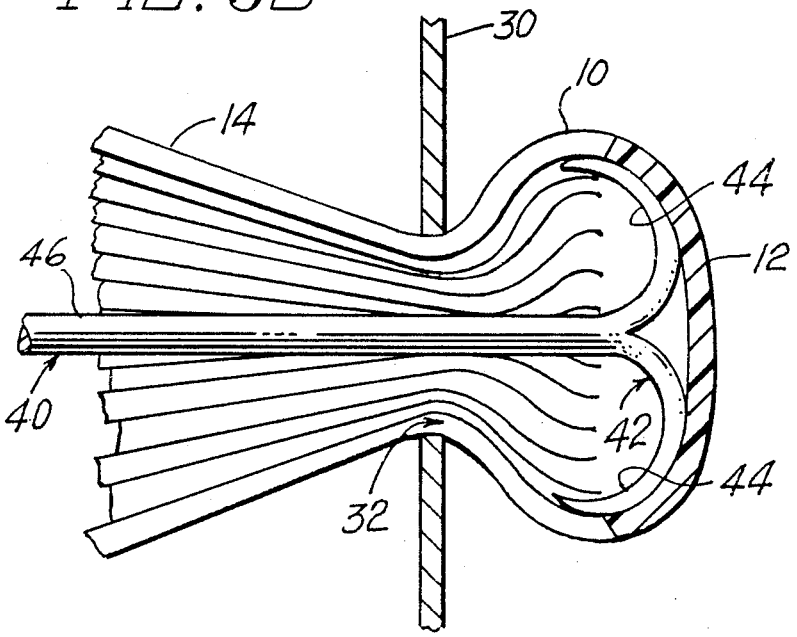
Figure 3C:
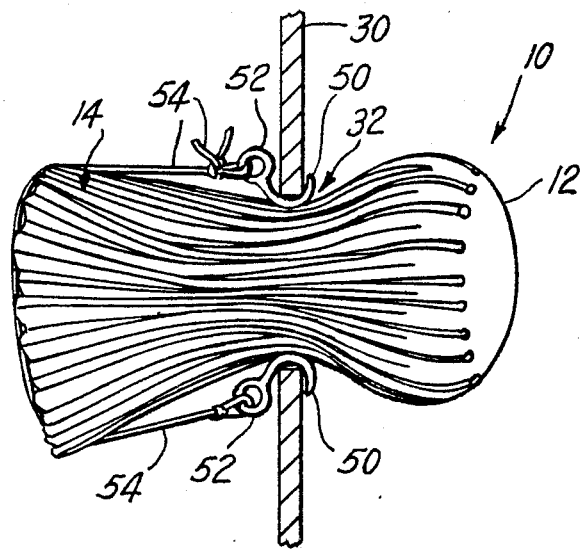

The plugging device depicted in FIGS. 1 and 2 may be inserted by hand or by an insertion device such as is depicted in FIGS. 3A, 3B and 3C, which figures also depict, in cross-section, a panel 30 having an aperture 32. In FIG. 3A, the insertion device comprises a push rod 34 having a head member 36 which can be used to contact the rear of body member 12 and assist in forcing it through aperture 32. The fingers 14 sweep in a bundle back and around the head 36 and rod member 38 of push rod 34. If the head member 36 is enlarged as shown in FIG. 3A, it may assist in preventing the plugging device from being forced back through the aperture by pressure from the right as shown in the figure. Alternatively, if the panel is the hull of a water-going vessel, for example, and if the push rod 34 is formed of a hydrophilic material, contact of the push rod with the water will cause at least the forward end of the push rod to expand to form the enlarged head 36 shown in FIG. 3A.

The insertion device 40 depicted in FIG. 3B has a forward end 42 which has a plurality of flexible arms generally indicated at 44 extending from rod member 46. Prior to insertion, the plugging device 10 is folded around the arms causing them to retract in towards rod member 46. After insertion, the ends of arms 44 extend outwardly away from rod member 46 so as to prevent the plugging device from being forced back out of aperture 32.

FIG. 3C illustrates an arrangement for retaining the plugging device 10 in aperture 32. Prior to insertion of the plugging device through the aperture, a pair of clips 50 having eyelets 52 are placed at opposing locations around the periphery of the aperture. After the plugging device is inserted through the aperture, which serves to retain the hooks at their locations around the aperture, a cord 54 is tied through the eyelets and around the rear of the trailing ends of the fingers 14. The hooks 50 and cord 54 help retain the plugging device 10 in the aperture.

It will be appreciated that the arrangement depicted in FIG. 3C can also be used in conjunction with the push rod 34 or insertion device 40 depicted in FIGS. 3A and 3B. The rear end of rod 34 or device 40 may be grooved to receive the cord, which may be winched tight to leverage the plugging device into the hole. The cord may be loosened slightly to allow the plugging device to relax and ensure that it blocks the aperture, and then tied to ensure retention of the device in the aperture.

Figure 4:
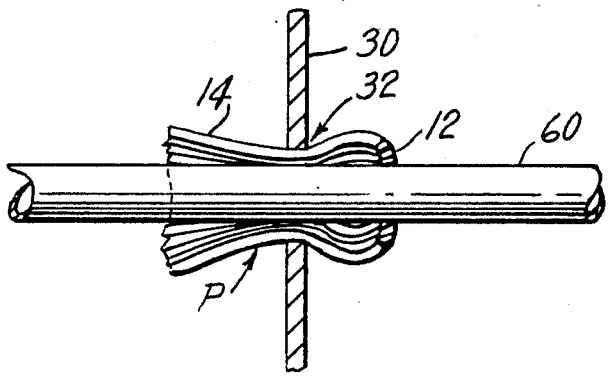
FIG. 4 illustrates a further use for a plugging device constructed in accordance with the invention, namely sealing an aperture through which another member extends.

The plugging device 10 according to the invention provides an inexpensive and easy to use device for plugging apertures of many shapes and sizes. It should be noted that if an aperture is very small, such as a puncture, it may be sealed by one or several of the fingers being forced therethrough. Further, if the hole is large, so that it cannot be efficiently sealed by one plugging device, several may be used in unison to seal the aperture. Furthermore, the plugging device may be used as depicted in FIG. 4 to seal around a smooth or irregularly-surfaced cable 60, for example, which goes through a panel 30. In this case, the body member 12 is provided with an opening through which the cable extends. The fingers 14 are swept back around the sidewall of the cable. When the cable is threaded through the aperture, the body member portion of the plugging device is pulled through first, followed by the fingers. The fingers seal the portion of the opening between the sidewall of the cable and the periphery of the aperture 32.

As has been mentioned, the plugging device may be formed of natural or synthetic rubber or another flexible and resilient material such as neoprene, where resistance to chemicals is required. When the plugging device is to be used with water-going vessels, it may be desirable to use a hydrophilic material, which can cause the deice to expand hold the device in the opening. Furthermore, the fingers can be formed with wavy or corrugated edges, which may enhance their retention in an aperture.

While the device has been described above as being formed of a resilient and flexible material such as rubber, it will be appreciated that different materials may be required in certain applications. For example, if the plugging device is to be used in high-pressure applications, the device may have a metal core with a resilient coating. Furthermore, it may be desirable to provide a plastic or somewhat fluid coating which may efficiently seal interstices between fingers. In addition, in specialized applications, it may be desirable to provide a coating that reacts with the air or with the fluid inside, for example, the tank sealed by the device, to form a hard mass to seal the aperture.

The foregoing description is limited to several specific embodiments of this invention. It will be apparent, however, that the invention may be practiced in numerous diverse embodiments and retain some or all of the aforementioned advantages. Therefore it is the object of the appended claims to cover all such modifications and variations which come within the true spirit and scope of the invention.

What is claimed as new and desired to be secured by Letters Patent of the United States is:

1. A plugging device utilizable for plugging an aperture in a panel for the stoppage of leaks therethrough, said plugging device comprising:

a sheet of flexible material, said sheet having a central body member and an outer peripheral edge;

a plurality of tapered fingers disposed in said sheet, arranged in a radially directed array outwardly from said central body member of said sheet, said fingers being defined by a plurality of first cleavages arranged at a particular radius from said central body member, said cleavages arranged radially therefrom, said first fingers having a minimum cross-section at their point of attachment to said central body member, out to a maximum cross-section at their distal ends which comprises the peripheral edge of said sheet, to facilitate a wedging of said plugging device into a cone-like shape when the central body member of said plugging device is first pressed into an aperture.

2. A plugging device utilizable for plugging an aperture in a panel as recited in claim 1, including a further plurality of radially directed second cleavages arranged at a second particular radius from said central body member, said second cleavages being arranged radially from said central body, and disposed between said first cleavages, to facilitate wedging of said fingers into any irregularities of an aperture.

3. A plugging device utilizable for plugging an aperture in a panel as recited in claim 2, wherein said sheet is formed from a resilient material.

4. A plugging device utilizable for plugging an aperture in a panel as recited in claim 2, including a further plurality of radially directed third cleavages arranged at a third particular radius from said central body member, to further facilitate wedging of said fingers into any irregularities of an aperture into which the plugging device may be pressed.

5. A plugging device utilizable for plugging an aperture in a panel as recited in claim 4, wherein said outer peripheral edge of said sheet is a disk of circular configuration.

6. A method of making a plugging device for plugging an aperture in a panel for the stoppage of leaks therethrough, comprising the steps of:

providing a disk of flexible resilient material having a central body portion and a perpherial edge;

arranging a plurality of radially directed cleavages about said central body portion at a minimum radius therefrom and through said disk, so as to define a plurality of flexible fingers having a minimum cross-section where there are joined to said central body portion of said disk, and tapering outwardly to a maximum larger cross-section at their distal ends which comprises said peripheral edge of said disk.

7. The method of making a plugging device for plugging an aperture in a panel as recited in claim 6, including:

arranging a second plurality of radially directed cleavages about a second radius from said central body portion so as to subdivide said flexible fingers into a further wedge shape, to facilitate their adaption into any irregularities of an aperture into which the plugging device may be pressed.

8. The method of making a plugging device for plugging an aperture in a panel as recited in claim 7, including:

arranging a third plurality of radially directed cleavages about a third radius from said central body portion so as to further subdivide said flexible fingers to further facilitate their adaptability into any irregulatities of a aperture into which the plugging device may be pressed.

9. A plugging device utilizable for plugging an aperture in a panel for the stoppage of leaks therethrough, said device comprising:

a conically shaped stopper of resilient material having a large end and a small end, said small end comprising a central body portion of said plugging device;

a plurality of first cuts arranged into said large end of said stopper, said cuts being directed towards and up to said central body portion of said stopper;

a further plurality of second cuts arranged into said large end of said stopper, said plurality of second cuts being arranged orthogonal to said plurality of first cuts, so as to define a plurality of resilient fingers of said stopper material, said cuts between said fingers defining a plurality of interstices therebetween, further effectuating the conical shape of said conical stopper, and to further facilitate their adaptability into irregular apertures, when the small end of the stopper may be pressed therein.

10. A plugging device utilizable for plugging an aperture in a panel as recited in claim 9, wherein each of said fingers of said stopper begin proximally at said central body portion with a minimum cross-section thereat, and extend distally towards the large end of said stopper, with a maximum cross-section at their distal ends.

11. A plugging device utilizable for plugging an aperture in a panel as recited in claim 10, wherein said second cuts have their relative orientations varied with respect to said plurality of first cuts to form fingers of differing cross-sections, to facilitate their adaptability into any irregularities in any aperture in which said stopper may be pressed.

* * * * *